US007271723B2

(12) United States Patent
Ando

(10) Patent No.: US 7,271,723 B2
(45) Date of Patent: Sep. 18, 2007

(54) CONTAINER DEVICE PROVIDED WITH SURVEILLANCE PANELS, SURVEILLANCE METHOD USING THE SAME DEVICE, AND STRUCTURE OF THE SAME DEVICE

(75) Inventor: Tanichi Ando, Kyoto (JP)

(73) Assignee: Omron Corporation, Shimogyo-ku (JP)

( * ) Notice: Subject to any disclaimer, the term of this patent is extended or adjusted under 35 U.S.C. 154(b) by 130 days.

(21) Appl. No.: 10/189,768

(22) Filed: Jul. 8, 2002

(65) Prior Publication Data

US 2004/0046660 A1 Mar. 11, 2004

(51) Int. Cl.
*G08B 13/08* (2006.01)

(52) U.S. Cl. ..... 340/545.6; 340/550

(58) Field of Classification Search ..... 340/545.6, 340/568.1, 550, 555; 109/41
See application file for complete search history.

(56) References Cited

U.S. PATENT DOCUMENTS 4,293,778 A * 10/1981 Williams ..... 340/550
4,999,608 A * 3/1991 Galomb ..... 340/550
6,556,138 B1 * 4/2003 Sliva et al. ..... 340/568.1
6,696,918 B2 * 2/2004 Kucharczyk et al. ..... 340/5.21

* cited by examiner

*Primary Examiner*—John Tweel, Jr.
(74) *Attorney, Agent, or Firm*—Foley & Lardner LLP

(57) ABSTRACT

The objective is the provision of intrusion detection sensor panels, which when used to enclose a closed space as a closed space apparatus, protect against the unlawful intrusion into that closed space, as well as the removal or secretion of articles into that closed space. To achieve that objective, the present invention provides a closed space apparatus comprised of intrusion detection sensor panels that detect intrusions over their entire surface. The intrusion detection sensor panels are not merely ones which incorporate a plurality of wire or point sensors over their surface, but they are characterized by being panels in which the overall panel functions to detect intrusions across its entire surface without gaps or lapses. Specifically, these surface detection function panels can be structured so that the panel interior or the side facing the closed space has an embedded optical fiber or fine electric wire at a specific density, so that if a part of the panel is broken or there is an intrusion from the outside, the severance of the optical fiber or fine wire is detected, to thereby guard the closed space against unlawful intrusion.

6 Claims, 8 Drawing Sheets

An optical fiber or electrical wire type of intrusion detection sensor panel 20

An optical fiber or electrical wire type of intrusion detection sensor panel 20

Two-layered liquid type of intrusion detection sensor panel 30

Electrodes type of intrusion detection sensor panel 40

Air chamber type of intrusion detection sensor panel

Surface pressure sensor type of intrusion detection sensor panel 60

CONTAINER DEVICE PROVIDED WITH SURVEILLANCE PANELS, SURVEILLANCE METHOD USING THE SAME DEVICE, AND STRUCTURE OF THE SAME DEVICE

FIELD OF THE INVENTION

The present invention relates to a closed space apparatus equipped with a plurality of intrusion detection sensor panels, a method of closed space surveillance employing such closed space apparatus, and the structure of the intrusion detection sensor panels. Here, "intrusion detection sensor panel" means a panel which contains a sensor function for the detection of intrusions, and "closed space apparatus" refers to all structures which are physically separated into a closed space such as containers or truck cargo chambers for the transportation of goods, the interior wall structure in buildings, the outside of safes, etc. Such intrusion detection sensor panels provide a surveillance function for the detection of unlawful intruders breaking the panels to gain access to the closed space, the taking of articles, etc. outside of that closed space following the intrusion, or conversely, the bringing of articles, etc. into the closed space without permission. As such, the present invention may be employed, for example, to assure the safe transport of containers.

BACKGROUND OF THE INVENTION

A number of methods are employed in the prior art for the security administration of closed spaces such as stores after closing, warehouses, safes, etc. Specifically, combinations of the below listed methods have been used.

(1) Prohibiting intrusion (2) Sealing doors (3) Detecting the disappearance of articles (4) Detecting the carrying out of articles (5) Detecting intruders (6) Detecting tools or the physical action of tools used for intrusion (7) Detecting actions following the intrusion (8) Detecting articles carried in.

With the increasing diversification of threats in recent years, we now face threats of the type that have not been experienced in the past. To wit, in the past, criminals with a profit motive would commit theft or other crimes, and almost all such threats could be dealt with by preventing the theft of articles or information. Now, however, new types of threats are on the rise. There are more and more instances of terrorists acts and the like which cannot be prevented by conventional security systems. As a result, there have been criminal acts which cannot be dealt with by the aforementioned conventional methods. Examples of such acts include:

(1) Secreting an explosive device into cargo, (2) Planting a bomb on a truck or container while it is being transported, (3) Creating disruptions of economic activity by reporting the planting of a bomb when none has actually been planted.

(4) Spreading bacteria or other hazardous material onto goods being transported.

In the past, the shipper confirmed the goods being transported and would make the proper notifications of whether or not those goods were hazardous. Now, however, there have been a number of crimes in which viruses or bacteria have been spread over the cargo, and even if the shipper has confirmed that the goods, their packaging, the means of transport, and the transporters are all safe, it is impossible to guaranty the safety of the goods once they arrive. Or, explosive devices can be secreted into trucks, ships or containers during transport, breaching the security measures that were deemed adequate, to thereby create the threat of a remotely controlled explosion once the goods have arrived at their destination.

To analyze the problems points surrounding the use of shipping containers, for example, the following types of problems are clearly inherent in the security methods of the prior art.

(1) The safe status of transport containers are only guaranteed for a very short period of time when they are in a secure state just prior to and just after being transported.

(2) When transport containers are being transported by truck, train, ship or aircraft, they are in an insecure state during a great deal of the time while they are being restacked or rerouted, or while under transport.

(3) Since theft is not always the objective, almost all containers need to be closely monitored, even those containing goods of little value.

(4) Using security personnel to keep watch over containers during their transport is unrealistic from a cost perspective.

(5) Strengthening container doors and locks to prevent theft does not deal with the new threats described above which can be carried out by intrusion through container walls, etc.

(6) In cases of dangerous actions wherein the actions following the intrusions or the physical properties or shape of articles secreted into the container cannot be predicted, vulnerabilities remain when the secreted article is not subjected to a proper detection method.

(7) When all of the goods that were loaded into the containers are all accounted for after their arrival with no items missing, security methods aimed at detecting theft are not adequate in providing comprehensive security.

(8) Possibilities to create social and economic disruption occur when false notifications are made that dangerous articles have been planted, causing a large quantity of transported goods to be stripped down and closely inspected.

In order to prevent damage from these types of crimes, it is necessary to guarantee that each and every container be maintained and kept in a safe and secure manner. However, within the current economic and commerce systems, there are a vast number of goods being transported, and accordingly, it is nearly impossible to maintain a secure state over each and every article being transported.

Also, in an era when there are ever-changing threats, it is very difficult to detect every article or action that could pose a threat before that threat materializes. Accordingly, the prior art, focused as it was on the detection and prevention of theft, is clearly inadequate to deal with these new contingencies.

Further, in the case of containers used for transport, it would be difficult to equip them with the same type of secure walls used in safes, and since they are easily accessed during their transport, they pose the highest risk of being subjected to unlawful actions.

SUMMARY OF THE INVENTION

The present invention addresses the above described issues, and has as its objective, the provision of a closed space apparatus equipped with intrusion detection sensor panels, wherein a certain space is enclosed by said panels, which detect and prevent unlawful intrusions into that space and the removal or secretion of articles from or into that space.

A further objective of the present invention is to provide a closed space surveillance method, which in addition to the closed space apparatus, records the detection of any irregular intrusion to thereby assure that the space has been maintained in a secure state.

To achieve the foregoing objective, the present invention provides a closed space apparatus having all of its constituent walls comprised of intrusion detection sensor panels. Said intrusion detection sensor panels are not merely comprised of a plurality of sensor points or wires being affixed to the panel, but rather, the entire panel is characterized by having a surface which can perform an intrusion detection function, without gaps or lapses, over its entire surface. Specifically, the panel surface capable of detecting intrusions, may be structured to embed or locate on the closed space side at a prescribed density, optical fibers or fine electric wires in a manner such that breaking a part of the panel could be detected as the breakage of the optical fiber or fine electric wires, to thereby construe a method of surveillance of unlawful intrusion into said closed space. Another method of imparting this intrusion detection function into intrusion detection panels would be to measure the resistance between two different types of liquids which are isolated by an insulator sheet, whereby any change in the detected resistance values would indicate that an act causing panel breakage had occurred.

Yet another means of imparting the intrusion detection function into an intrusion detection surface is to affix two electrode panels separated by an insulator sheet over the entire surface of the panel and detect any change in the electrical resistance values between the two electrode panels as a means of detecting an act that caused panel breakage.

Still another means of imparting the intrusion detection function into an intrusion detection surface is to detect any changes in the air pressure in an air chamber sandwiched inside the panels as a means of detecting an act that caused panel breakage.

Yet another example of a means of construing the intrusion detection function into an intrusion detection surface is to configure the panel surface as a surface pressure sensor that detects any change in the pressure value of the panel as a means of detecting an act that caused panel breakage.

Further, the present invention can incorporate an intrusion recording unit that records the above described unlawful intrusion data as a means of maintaining surveillance over the inside wall structure of buildings or over the unlawful intrusion into property inside of containers, etc. For example, an intrusion recording unit can be placed inside of a container, or sandwiched inside of the intrusion detection panels to record the date and time, along with the ID number allocated to the container. This unlawful intrusion data then could be read wirelessly when the container arrived at its destination port, and if any unlawful intrusion data had been recorded, that container could be subjected to special handling measures and a detailed inspection.

As described above, the closed space apparatus configured from intrusion detection sensor panels according to the present invention can be used for detection in a multitude of applications, such as containers, to easily perform surveillance for unlawful intrusion into highly vulnerable objects of surveillance. To wit, employing the method of closed space surveillance of this invention, for example, when a container is unloaded from a ship at its destination container yard, it is easy to identify a container subjected to unlawful intrusion, which, as a result, makes it possible to efficiently handle the container as required. Further, since it is not necessary to make a detailed individual check upon each object of surveillance, it is possible to avoid the huge costs involved in making numerous checks, and to assure safe container transport by performing detailed checks on only those containers identified as being potentially dangerous.

Furthermore, since the present invention makes it possible to detect any unlawful intrusion on all of the wall surfaces containing the closed space, it can be effectively used without advance knowledge of the means or the object used to perform the intrusion. Accordingly, once the closed space apparatus or method of closed space surveillance of this invention has been initiated, the container can be transported securely without changing the apparatus or surveillance method even if, for example, it were to be subjected to a new type of threat from a terrorist.

DETAILED DESCRIPTION OF THE INVENTION

In this section we shall explain several preferred embodiments of this invention with reference to the appended drawings, which relates to a closed space apparatus equipped with a plurality of intrusion detection sensor panels, a method of closed space surveillance employing such closed space apparatus, and the structure of the intrusion detection sensor panels. Whenever the size, materials, shapes, relative positions and other aspects of the parts described in the embodiments are not clearly defined, the scope of the invention is not limited only to the parts shown, which are meant merely for the purpose of illustration.

Figure 1:
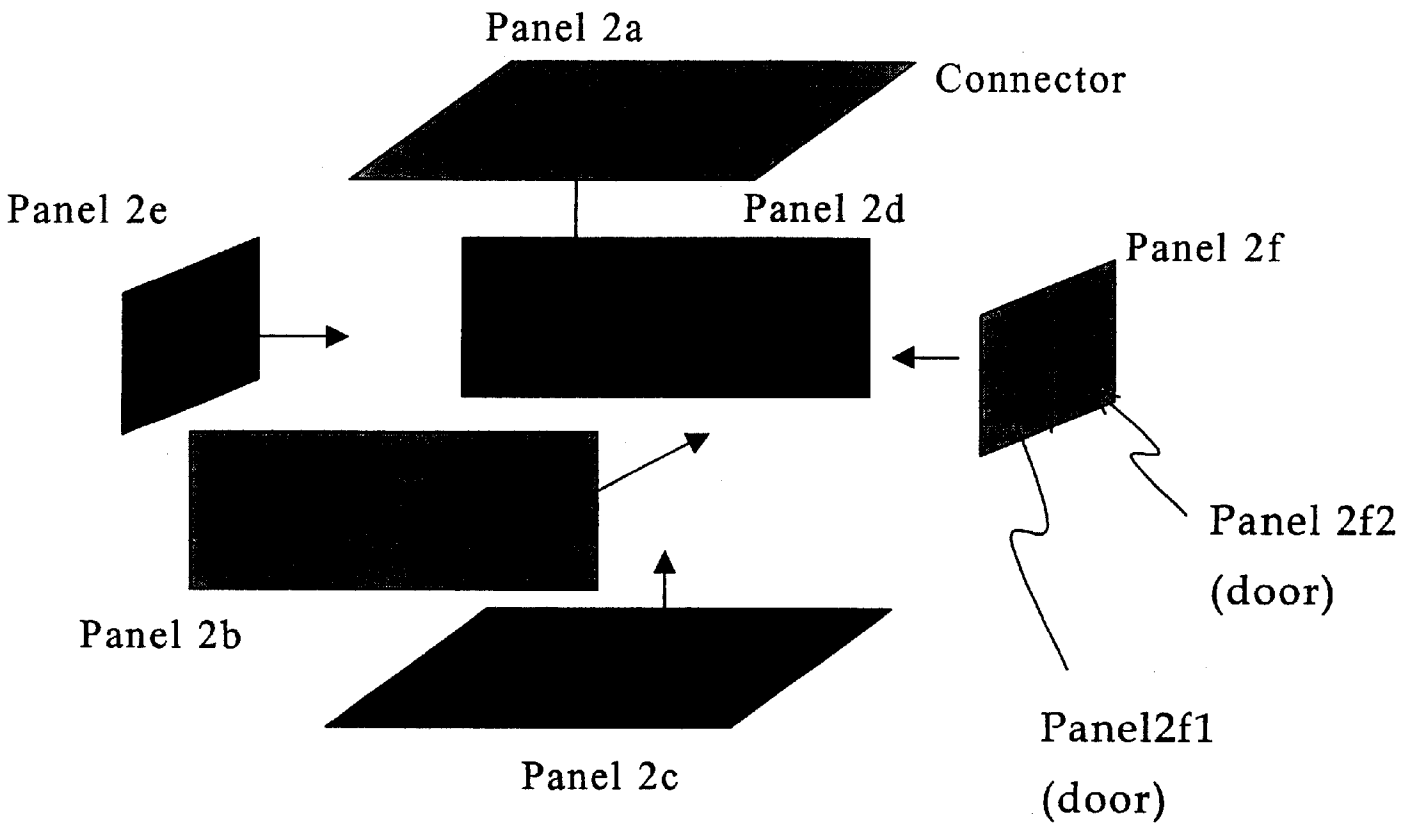
FIG. 1 is a diagram of an external view of the intrusion detection senor panels comprising the closed space apparatus of this invention.

FIG. 1 is a diagram of an external view of the closed space apparatus comprising the intrusion detection senor panels according to this invention. What is meant by "the closed space apparatus 1" is any enclosed structure such as the cargo hold of a transport container or truck, the inside of walled in structure in a building, or other such space closed to the outside, however the explanation below will refer specifically to the structure of a transport container such as used in container ships. The size, shape, materials, and value-added functions of containers 1 used for shipping are strictly prescribed by international specifications. Generally, such containers 1, have an opening approximately 2 meters square and are 20 feet or 40 feet long. Most of them are made of steel or aluminum plate, and, as shown in the figure, are constructed from panels 2*a*-2*f*. These, as will be detailed later, are functionally connected by connector 3 as a means of detecting unlawful intrusions. One of the surfaces in the lengthwise direction (e.g. panel 2*f*) is comprised of outward opening doors, 2*f*1 and 2*f*2.

Before cargo is being loaded inside the container, first a container tow vehicle tows the empty container to the area designated by shippers, where it is loaded with cargo. Since multiple containers are stacked atop each other when loaded onto the ship, the containers are of sturdy construction, especially in the vertical direction. Once they arrive in their port of destination, the containers are unloaded from the ship by means of a container lift, and if the containers are from a foreign country, all or some of them are subjected to a customs inspection before being transported by a tow vehicle to their final destination. Thus, once the containers leave the hands of the shipper and until they reach their ultimate destination, the space inside is subject to any imaginable danger. Thus, in order to assure that the closed space inside of the container has not been invaded since it was sealed, it is necessary to assure that none of the surfaces containing the closed space have been breached, not even once.

For this reason, the present invention, especially to protect the container against a terrorist, employs container panels 2 (on the floors, side walls and ceiling) as shown in FIGS. 2 through 6, which are entirely configured over their entire surfaces, without gaps or lapses, with an intrusion detection function to comprise intrusion detection sensor panels. Said intrusion detection function, in order to protect against unlawful intrusion through the panels of container 1, is incorporated at densities over the entire surfaces of the panels 2 such that detect any unlawful intrusion (by humans, or suspicious objects inserted through drilled holes) by detection of abnormalities. Accordingly, the present invention prescribes no particularly sensor density.

Figure 2:
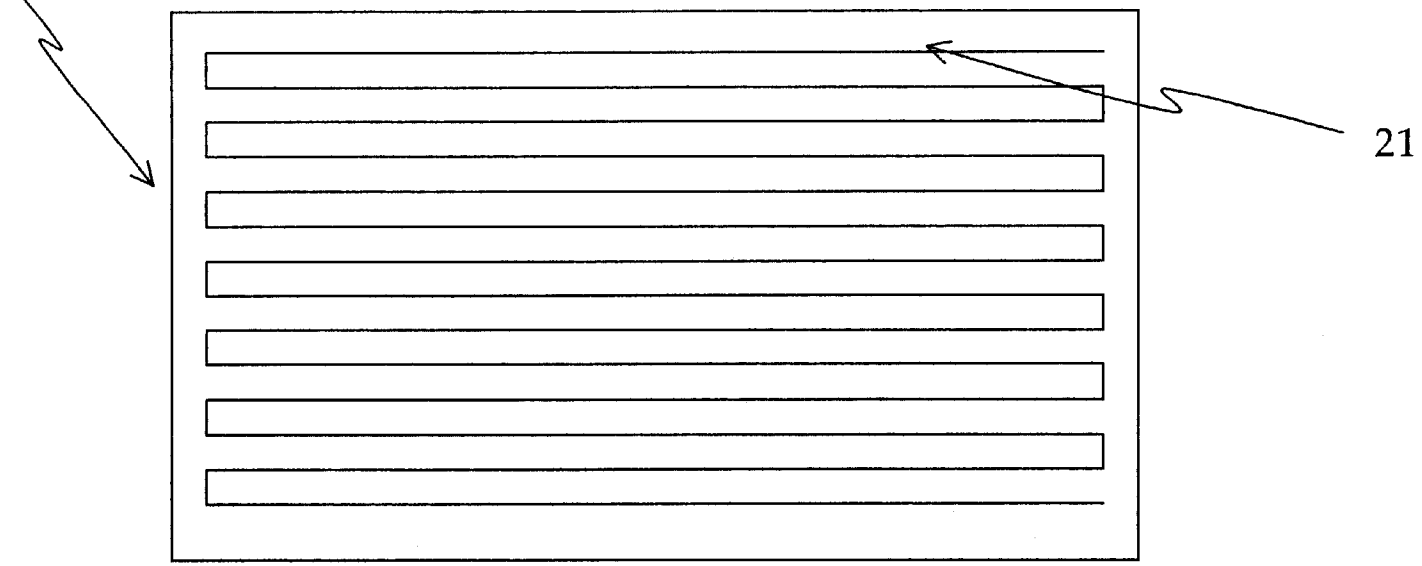
FIG. 2 is a sectional view of an embodiment of an intrusion detection sensor panel according to this invention that employs optical fibers or electric wires in the intrusion detection sensor panel.

FIG. 2 shows a sectional view of the entire surface of a panel that functions as a detection surface that detects any intrusion over the entire panel surface; this embodiment of the intrusion detection sensor panel according to this invention uses an optical fiber or electrical wire to fabricate a wire-type of intrusion detection sensor panel 20. One strand of the optical fiber 21 is installed back and forth to cover the entire surface of the panel. A signal input unit (not shown) inputs light into one end of the optical fiber 21, and that light output is detected on the other end by a signal output unit. If an intrusion opening is made in the panel, the optical fiber 21 is severed, and the intrusion can be detected by the output light no longer being received at the other end. In this embodiment, light is constantly input into the optical fiber, but the material is not limited to optical fiber. Fine electrical wire carrying an electrical signal or other medium may be used so long as it is capable of passing a constant signal.

Figure 3:
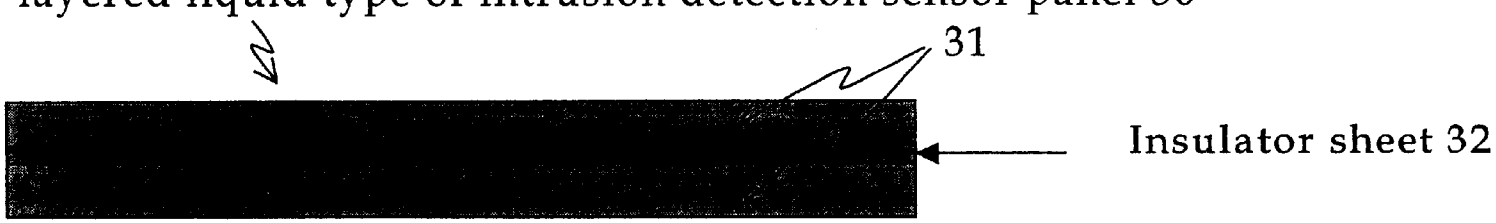
FIG. 3 is a sectional view of an embodiment of an intrusion detection sensor panel according to this invention that employs a two-liquid type of intrusion detection sensor panel.

FIG. 3 shows a sectional view of the entire surface of a panel that functions as a detection surface that detects any intrusion over the entire panel surface; this embodiment of the intrusion detection sensor panel according to this invention uses a two-layered liquid type of intrusion detection sensor panel 30. Conductive liquids 31, 31 are separated by an insulator sheet 32; it is possible to detect any holes in the insulator sheet by measuring the electrical resistance between the two liquids. The liquids may be in gel form, and preferably, the insulator sheet should be made from the type of material that when a hole is made in the sheet, the hole spontaneously becomes larger. When no holes are made in the insulator sheet, the resistance between the two liquids is very high, but when a hole is made, and a liquid leaks, the resistance decreases. When the electrical resistance falls below a certain threshold, a signal can be output that indicates an unlawful intrusion.

Figure 4:
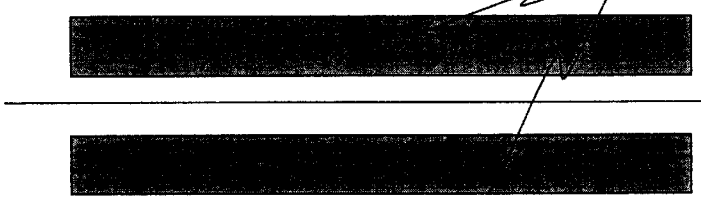
FIG. 4 is a sectional view of an embodiment of an intrusion detection sensor panel according to this invention that employs two isolated electrode panels in the intrusion detection sensor panel.

FIG. 4 shows a sectional view of the entire surface of a panel that functions as a detection surface that detects any intrusion over the entire panel surface; this embodiment of the intrusion detection sensor panel according to this invention uses an insulator between two electrodes to construe the intrusion detection sensor panel 40. The two electrodes 41, 41 are insulated by a tear-resistant insulator sheet 42. If an attempt is made to make a hole in the panel, the insulator sheet 42 does not tear but moves in a horizontal direction. This movement of the insulator sheet closes the circuit between the electrodes and causes the resistance between them to decrease. When the electrical resistance decreases beyond a certain threshold, an intrusion signal is output. Even in the case of a small intrusion, such as by a needle, when it passes through the insulator sheet without causing it to tear, it causes the electrodes in the area to make contact and become conductive.

Figure 5:
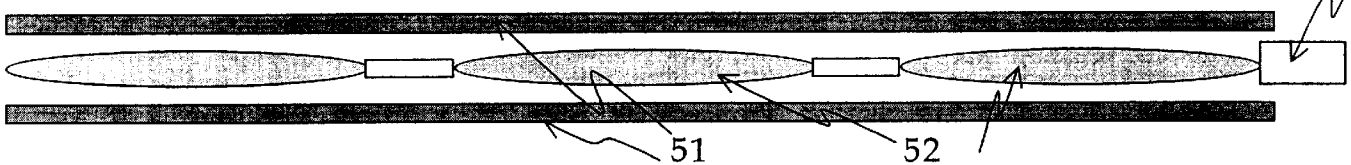
FIG. 5 is a sectional view of an embodiment of an intrusion detection sensor panel according to this invention that employs an air chamber type of intrusion detection sensor panel.

FIG. 5 shows a sectional view of the entire surface of a panel that functions as a detection surface that detects any intrusion over the entire panel surface; this embodiment of the intrusion detection sensor panel according to this invention uses an air chamber type of intrusion detection sensor panel 50. An air chamber 52 is sandwiched between two panels 51, 51. The air chamber may be made of a resilient resin film, for example. Any holes in the air chamber would cause the air to leak out and make the resulting pressure drop detectable. In the embodiment in the figure, a plurality of air chambers are connected by hollow pipes, and one air pressure sensor 53 is used as the detector. The entire surface between the panels with the can be covered by air chambers 52, or a single panel may be covered by the air chamber. Alternatively, the panels may be constructed to form an air chamber within, or alternatively, a liquid chamber could be used instead of an air chamber. Further, instead of detecting pressure, it would also be possible to detect gas or liquid leakage.

Figure 6:
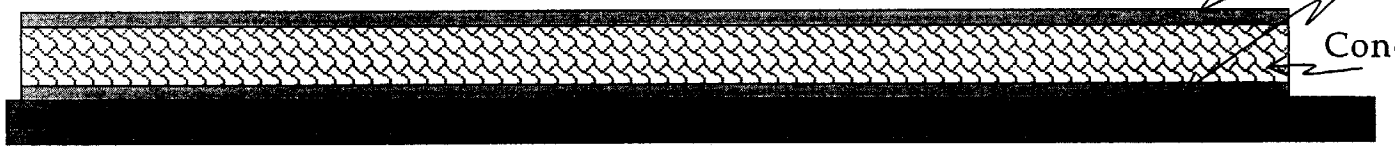
FIG. 6 is a sectional view of an embodiment of an intrusion detection sensor panel according to this invention that employs a surface pressure sensor intrusion detection sensor panel.

FIG. 6 shows a sectional view of the entire surface of a panel that functions as a detection surface that detects any intrusion over the entire panel surface; this embodiment of the intrusion detection sensor panel according to this invention uses a surface pressure sensor type of intrusion detection sensor panel 60. Such a surface pressure sensor scheme may be realized, for example, by sandwiching an electrically conductive sponge 63 between two conductive sheets 62, 62 and attaching a surface pressure sensor 61 to the panel. Should an attempt be made to put a hole in the panel, the conductive sponge 63 would be pressed upon and compress. When the conductive sponge is compressed, the decreased resistance value between the two conductive sheets 62, 62 can be detected. Other methods may also be used to detect the surface pressure. In order to improve the precision of this detection, such as when a hole was to be made with a small object such as a needle, the sheets should be made of a material that is resistant to piercing by pin holes in order to make sure that the conductive sponge is compressed.

In the above-described embodiments, the various intrusion detection sensor panels are such that they could be retrofitted to existing containers, but it is of course possible to incorporate such structures inside the walls of the containers during their manufacture. Currently, there are more than 14 million containers in use throughout the world, and their longevity is rated at about 10 years. It is certainly possible that such embedded invasion detection sensor panels will be a requirement for future container fabrication.

As described above, the closed space apparatus (in containers) is structured by fitting any of the various types of intrusion detection sensor panels, which have intrusion detection functions over their entire surface without gaps or lapses, to create the closed space. Since such containers can be left for long periods of time without security, if the closed space is breached by an attack from the outside, it is necessary for an internal intrusion recording unit to record the fact of that attack as detected by the sensor panels.

Figure 7:
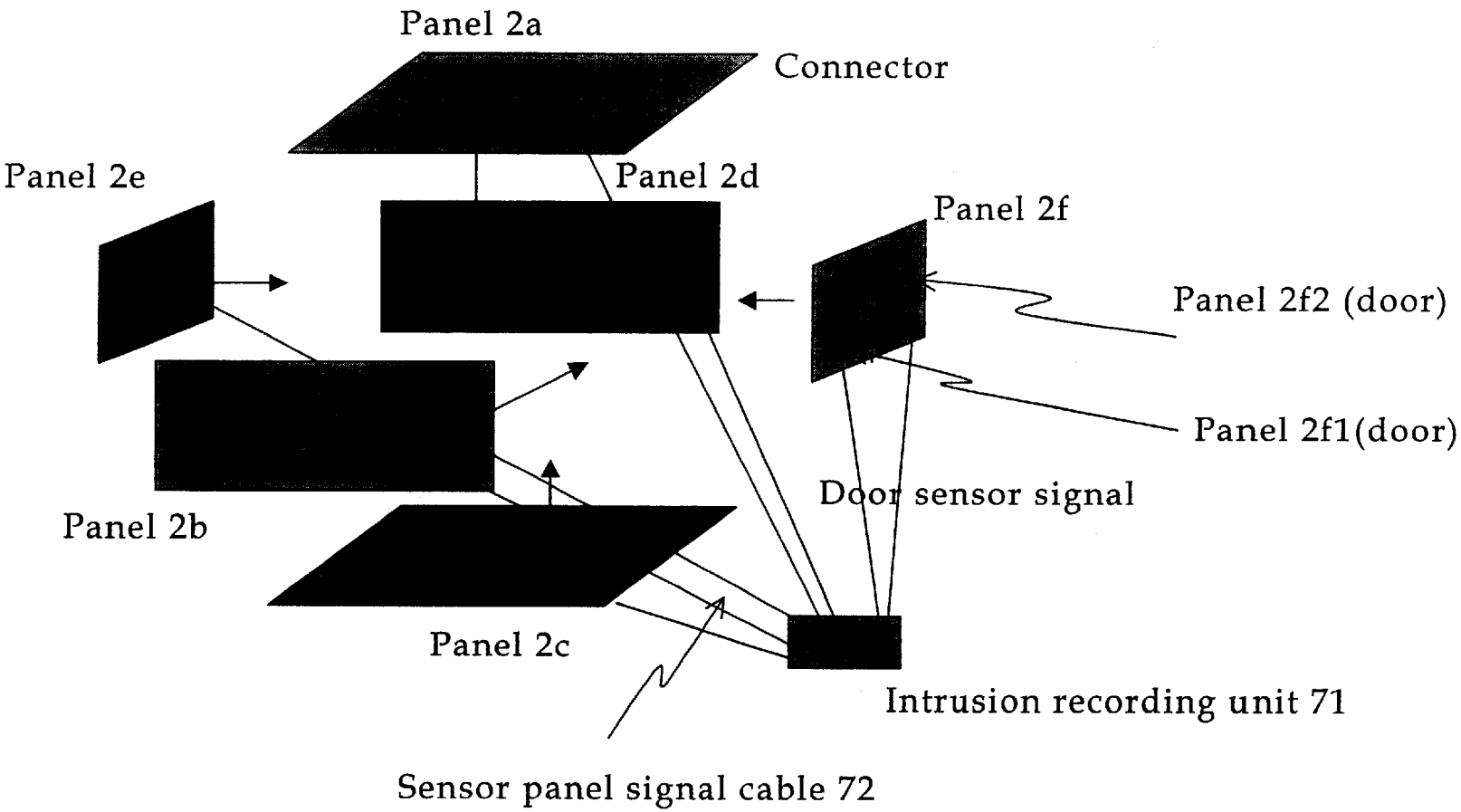
FIG. 7 is a diagram showing an external view of the closed space apparatus equipped with intrusion detection sensor panels of this invention to which an intrusion recording unit has been added.

FIG. 7 is a diagram shown the external view of a closed space apparatus equipped with the intrusion detection sensor panels according to this invention which incorporates the above described intrusion recording unit 71. In this embodiment, the sensor panel can detect the possibility of an intrusion, and the installation of the intrusion recording unit 71 provides assurance, even when no intrusion has occurred. In the present embodiment, the closed space is comprised of 6 panels, which are all connected by the sensor panel signal cable 72. It would also be possible to connect a signal cable to each panel and then later connect those to the intrusion recording unit 71. Then when an attempt was made to make a hole, etc., in any area on any of the surfaces of the sensor panels 1 through 6, the detection data is sent via the sensor panel signal cable to the intrusion recording unit 71.

As described above, for the case of a container, etc., which is subjected to dangerous environments during its transport, it is difficult to consider all of the various means which would be required to detect unlawful intrusion, especially through external locks or seals on the doors. Thus, by incorporating an internal sensor which detects the opening and closing of the door mechanism, it is possible to create a record of possible intrusions. Further, since there is concern of intrusions through the non-sensor equipped areas where the panels connect with each other, either a sensor surface can overlay the sensor panel surface in these areas, or the joints can be reinforced to prevent intrusion in the joint areas.

Also, in the case that a terrorist or other person would tamper with the intrusion recorder device 71 or swap out its contents with false information to make it impossible to determine whether or not an intrusion had occurred, it would be desirable to locate the intrusion recorder device inside of the closed space. It would be further desirable to incorporate an inspection means for the intrusion recording unit to assure it was accurate. For example, this could be performed by the allocation of a randomly generated ID number for each device.

Figure 8:
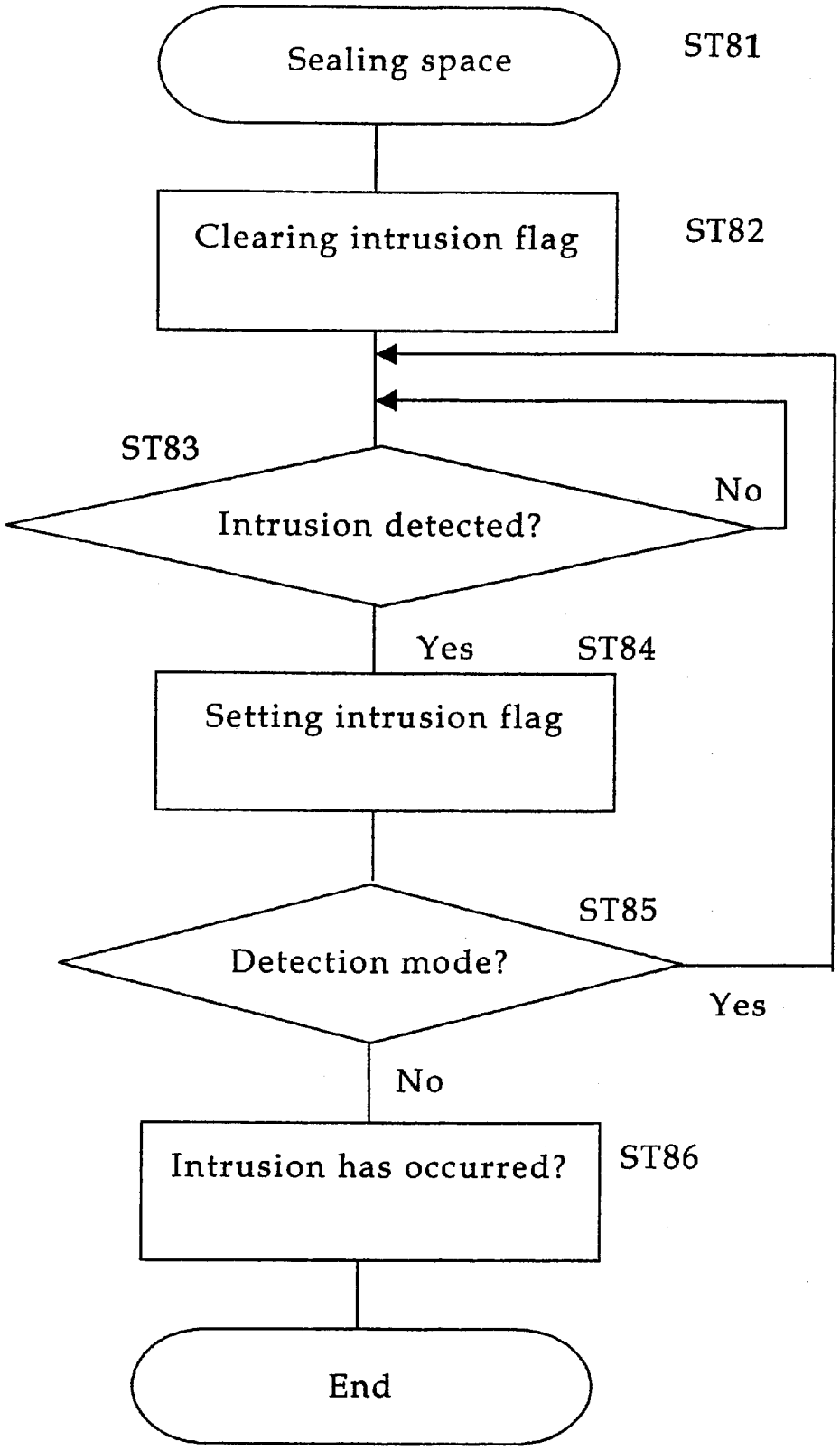
FIG. 8 is a flow chart of the operation of the intrusion recording unit of FIG. 7.

FIG. 8 is a flow chart describing the operation of the intrusion recording unit 71. When the closed space inside a container, etc. is sealed (ST81), first the intrusion flag of the intrusion recording unit 71 is cleared (ST82), and it is placed in the intrusion detection mode. Intrusion detection data is acquired (ST83) from an intrusion detection sensor panel 2, which has the capability to detect intrusions over the entire panel surface. Normally, the container will arrive at its destination without any detection of an intrusion, but if an unlawful intrusion has occurred, an intrusion flag is set (ST84), and the device returns to its detection mode to detect the presence or absence of further intrusions. After that, when the container arrives at the container yard, an external reading apparatus, etc., which will be described below, is used to read whether or not an intrusion has occurred (ST86), and then the required response is made.

Figure 9:
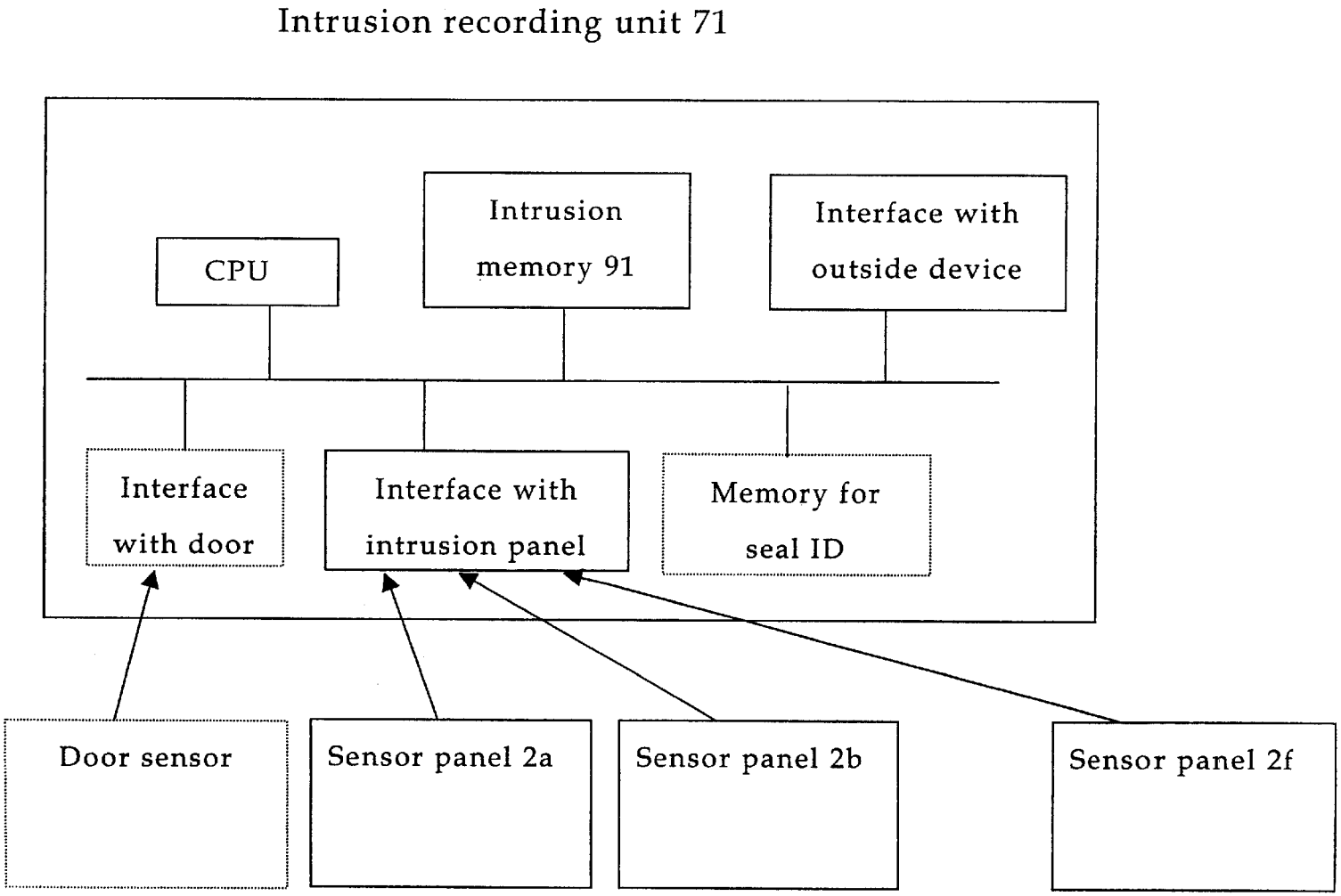
FIG. 9 is a block diagram showing the structure of the intrusion recording unit of FIG. 7.

FIG. 9 is a block diagram of the intrusion recording unit 71 shown in FIG. 7. The intrusion recording unit 71 detects the output from the sensor panels. Should the possibility of unlawful intrusion be detected by any of the sensor panels, the unit records a notation of that intrusion status. In cases where there is to be an investigation of the intrusion, it is preferable to record such sensor information as the name or number of the detecting sensor, and other information regarding the time, date and location of the occurrence. The intrusion status recording is stored as intrusion flags. In order to prevent tampering with the intrusion recording unit or swapping out its information, a seal ID can be recorded in the seal ID record area which can be confirmed by external check. It is further preferable that the intrusion recording unit be capable of making wireless notification of its status to the outside. In the present embodiment, the sensor panels and the door sensors are connected to the device by cables, but this could also be accomplished wirelessly.

Figure 10:
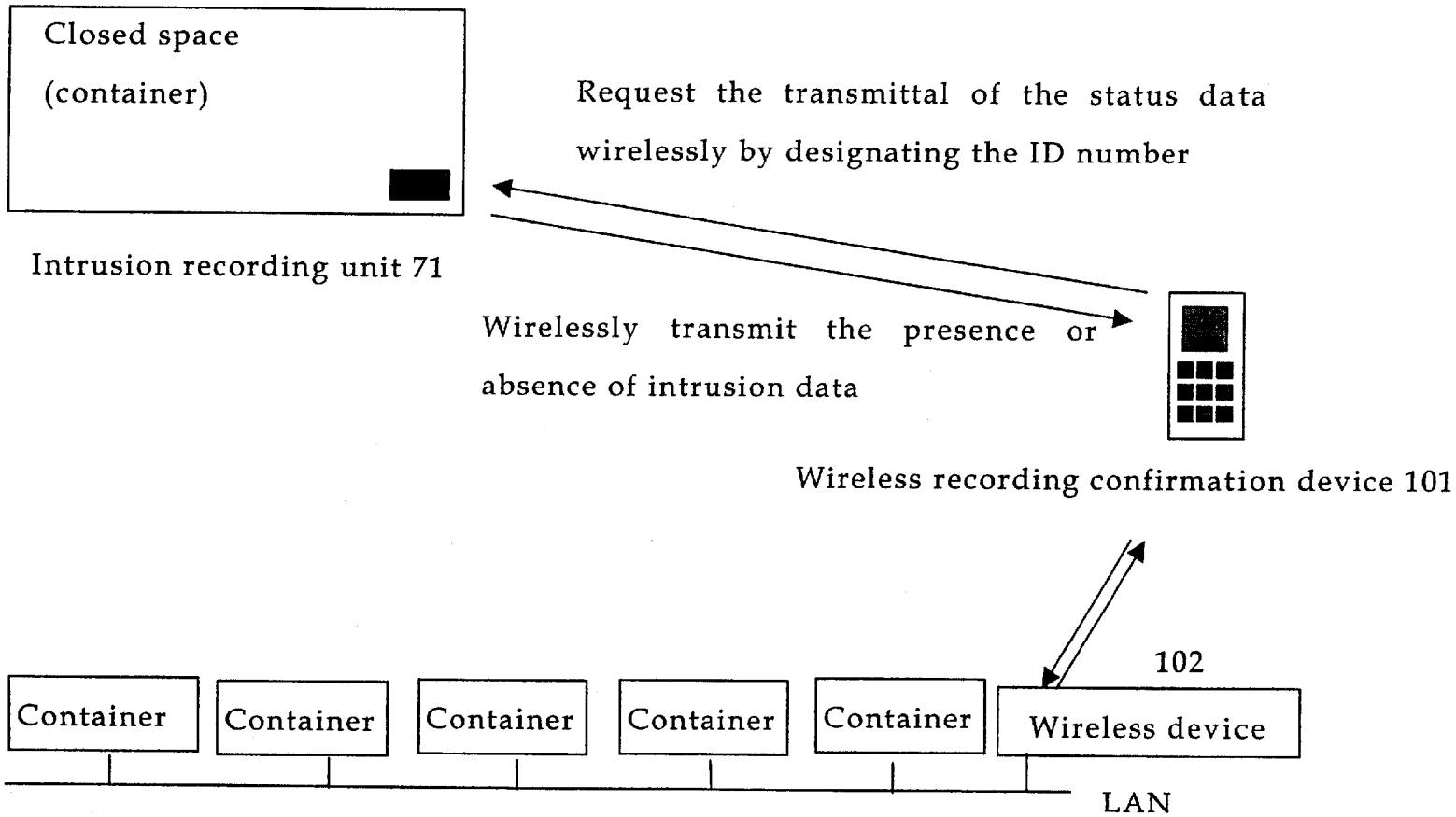
FIG. 10 is a diagram showing a closed space surveillance system according to the present invention, which uses a wireless type of recording confirmation device that reads out the unlawful intrusion data from the intrusion recording unit of FIG. 9.

FIG. 10 is a diagram of a closed space surveillance system according to this invention, which shows how data about unlawful intrusions can be acquired from the intrusion recording unit 71 shown in FIG. 9 using a wireless type of recording confirmation device 101. This wireless recording confirmation device 101 is capable of confirming from the outside, the intrusion status data from the intrusion recording unit 71 that is inside the closed space. It is most important that the wireless communication method be resistant to tampering. First, one would have to request the transmittal of the status data wirelessly by designating the ID number, etc. of the intrusion recording unit 71. Then, the intrusion recording unit 71 would wirelessly transmit the presence or absence of intrusion data. Another possibility is for the container to be connected with a LAN, and its status confirmed by means of a wireless transmitter on the carrier, such as train or ship.

Figure 11:
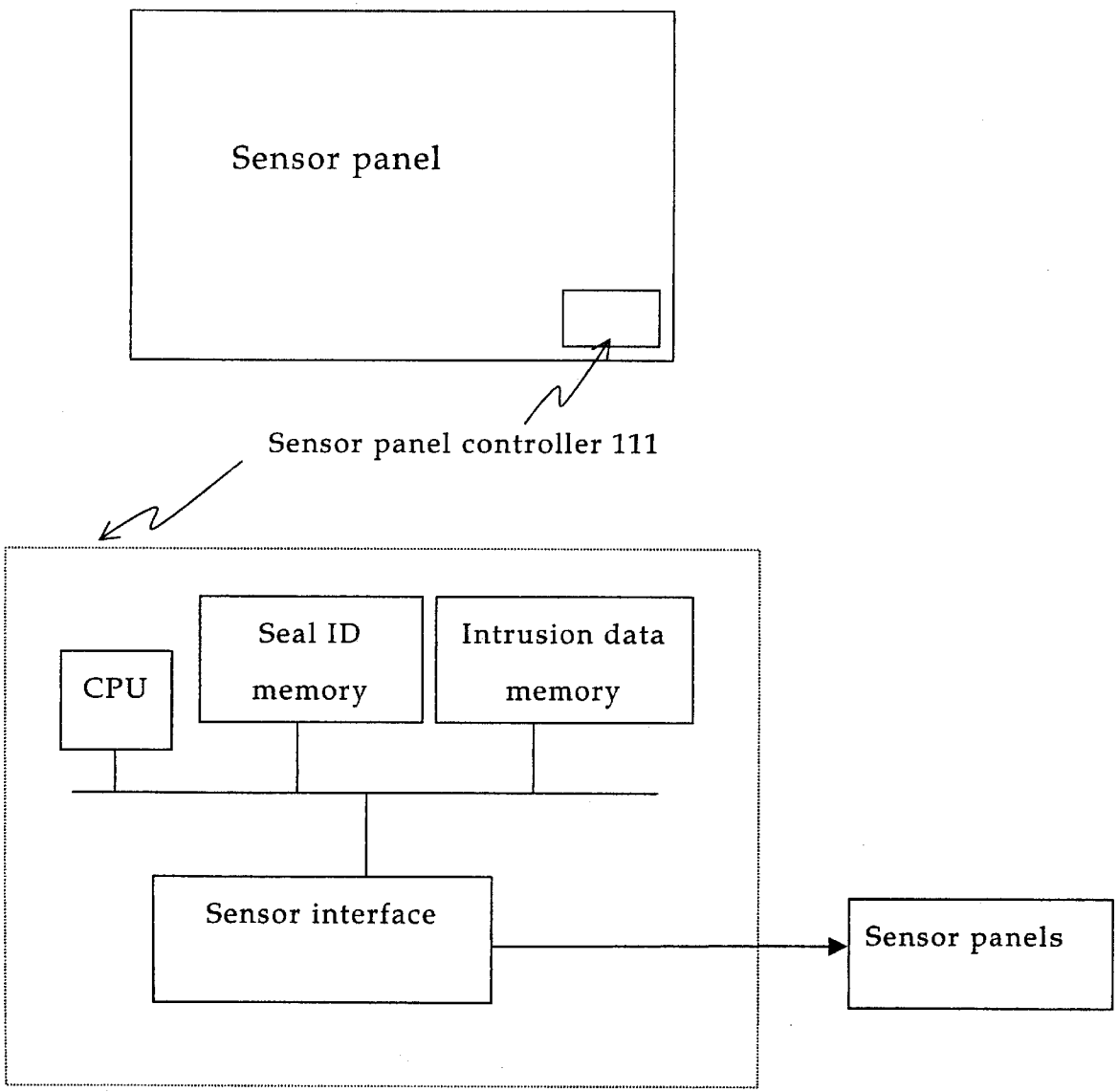
FIG. 11 is a diagram of the intrusion recording unit shown in FIG. 7 affixed inside of an intrusion detection sensor panel.

FIG. 11 is a diagram showing the intrusion recording unit of FIG. 7 being attached inside of an intrusion detection sensor panel. A CPU incorporating a sensor panel controller can be installed inside of the sensor panel. Incorporating the sensor panel controller inside of the sensor panel makes it possible for the sensor panel to perform independent processing, which guards against the threat of tampering with or swapping out the unit.

In order to prevent the sensor panel and intrusion recording unit from being replaced with new ones after breaching a sensor panel, or to protect against the sensor panels or intrusion recording units from being tampered with or swapped out, it is necessary to detect the instances or tampering or exchange. There are a number of methods that can be used to protect against tampering or exchange. An example, which is used on door seals, is to use a one time seal having inscribed ID information on the sensor panel and intrusion recording unit which may be checked by external observation. This makes it possible to confirm all of the ID information for the sensor panels and intrusion recording units from the outside. It is also possible to employ electronic anti-tampering methods such as electronically coded signatures.

Effects of the Invention

As detailed above, the present invention is characterized by being capable of detecting unlawful intrusions on all of the wall surfaces constituting a closed space, without requiring any advance information about the means or objects used for the intrusions, or any action that followed the intrusion. Accordingly, the closed space apparatus and the closed space surveillance method proposed by this invention is, following its activation, effective continually throughout transport, in maintaining the security without changing the method or device used for surveillance, even in the face of new types of threats, such as from terrorists. As depicted especially in FIGS. 2 through 6, the use of intrusion detection sensor panels, which incorporate intrusion detection functions without gap or lapses over the entire surface of the panels, effectively protects against a terrorist, etc. from intruding into the container walls.

Further, the use of the surveillance method of this invention obviates the need to make individual checks of each container, and thereby eliminates the huge costs of inspecting all containers upon arrival; it is only necessary to inspect those containers selected out as potentially dangerous. The invention makes possible secure container operations. To wit, when the container is unloaded at its destination from the container ship, it is possible to easily identify any containers subjected to unlawful intrusion. This makes possible the highly efficient processing of containers.

What is claimed is:

1. A closed space apparatus comprising:

all of the constituent walls of the closed space provided with a plurality of intrusion detection sensor panels on all of the inner walls of said apparatus, each of said intrusion detection sensor panels having a panel surface to detect an intrusion from any portion of the constituent wall of said closed space apparatus, wherein said plurality of said intrusion detection sensor panels are additionally attachable on all of the inner walls of existing conventional closed space apparatus having no intrusion detection sensor panels, wherein each of the inner walls of said apparatus is provided with said intrusion detection sensor panel over the entire surface of the inner wall without any gaps or lapses, wherein said intrusion detection sensor panel having an entire surface to detect said intrusion comprises:

an optical fiber or fine electric wire configured at a prescribed density that covers the entire surface of the inner wall;

a signal input unit that inputs a signal into one end of said optical fiber or fine electric wire; and a signal receiving unit that receives said input signal at the other end of said optical fiber or fine electric wire, wherein said intrusion is detected if said input signal is no longer received at the other end by said signal receiving unit in the event that said optical fiber or fine electric wire is broken by an unlawful intrusion through said wall of said closed space apparatus.

2. The closed space apparatus according to claim 1, wherein said closed space apparatus is either a container, a building or a safe.

3. The closed space apparatus according to claim 1, wherein said closed space apparatus is either a container, a building or a safe, and said intrusion detection sensor panels are sandwiched in the constituent walls of said closed space apparatus.

4. The closed space apparatus according to claim 1, further comprising an intrusion recording unit which records an unlawful intrusion data detected by said intrusion detection sensor panels, and an ID data previously assigned for each apparatus, said intrusion recording unit further provided with an output means to output said recorded unlawful intrusion data from said closed space apparatus, and said intrusion recording unit being placed inside of said closed space apparatus or sandwiched in one of said constituent walls.

5. A surveillance method to perform surveillance for unlawful intrusion through constituent walls of a closed space apparatus, comprising the steps of:

detecting a normal signal of a normal status of said closed space apparatus by intrusion detection sensor panels installed inside of said apparatus, said intrusion detection sensor panels being additionally attachable on all of the inner walls of existing conventional closed space apparatus having no intrusion detection sensor panels, said panels having a detection means to detect said unlawful intrusion into said apparatus from any portion of the constituent walls of said closed space apparatus without any gaps or lapses, wherein each of said intrusion detection sensor panels includes an optical fiber or electric wire configured at a prescribed density that covers the entire surface of the constituent wall without any gaps or lapses;

outputting a real time surveillance signal which is detected by said intrusion detection sensor panels in a surveillance mode, or recording said real time surveillance signal in an intrusion recording unit being placed inside of said closed space apparatus or sandwiched in one of said constituent walls; and comparing said surveillance signal which is output real time or output from said intrusion recording unit, and said normal signal for detecting said unlawful intrusion into said closed space apparatus.

6. An intrusion detection sensor panel comprising:

an intrusion detecting means over the entire surface of respective constituent walls of a closed space apparatus to detect an intrusion from any portion of said constituent walls without any gaps or lapses, said intrusion detecting means being provided inside of said constituent walls or sandwiched in said constituent walls of said closed space apparatus, said intrusion detection sensor panels being additionally attachable on all of the inner walls of existing conventional closed space apparatus having no intrusion detection sensor panels, wherein said intrusion detection means comprises:

an optical fiber or fine electric wire configured at a prescribed density that covers the entire surface of the constituent wall;

a signal input unit that inputs a signal into one end of said optical fiber or fine electric wire; and a signal receiving unit that receives said input signal at the other end of said optical fiber or fine electric wire, wherein said intrusion is detected if said input signal is no longer received at the other end by said signal receiving unit in the event that said optical fiber or fine electric wire is broken by an unlawful intrusion through said wall of said closed space apparatus.

* * * * *